US005234465A

United States Patent [19]

Hähnke et al.

[11] Patent Number: 5,234,465

[45] Date of Patent: Aug. 10, 1993

[54] PAD-DYEING OF CELLULOSE FIBERS WITH SULFUR BLACK DYES: MIXTURE OF DITHIONITE AND GLUCOSE REDUCING SUGAR AS REDUCING AGENT IN AQUEOUS ALKALINE DYE BATH

[75] Inventors: Manfred Hähnke, Kelkheim; Ullrich Saalfrank, Eppstein/Taunus; Claus Schuster, Hofheim am Taunus; Joachim Steinbach, Frankfurt am Main; Gerd Krauzpaul, Liederbach, all of Fed. Rep. of Germany

[73] Assignee: Hoechst Aktiengesellschaft, Frankfurt, Fed. Rep. of Germany

[21] Appl. No.: 827,290

[22] Filed: Jan. 29, 1992

[30] Foreign Application Priority Data

Jan. 31, 1991 [DE] Fed. Rep. of Germany ..... 4102811

[51] Int. Cl.[5] ..... D06P 1/30; D06P 3/60

[52] U.S. Cl. ..... 8/561; 8/618; 8/650; 8/651; 8/652; 8/918

[58] Field of Search ..... 8/561, 650, 651

[56] References Cited

U.S. PATENT DOCUMENTS

| | | | |
|---|---|---|---|
| 4,801,303 | 1/1989 | Carlough et al. | 8/532 |
| 4,992,078 | 2/1991 | Meszards | 8/444 |
| 5,030,248 | 7/1991 | Meszards | 8/652 |

*Primary Examiner*—A. Lionel Clingman
*Attorney, Agent, or Firm*—Connolly and Hutz

[57] ABSTRACT

Cellulose fibers are dyed ecologically soundly with sulfur black dyes by the pad-dyeing process by avoiding sulfides as reducing agent by replacing them by a dithionite-based mixture with at least one reducing sugar. A high color yield, a deep black shade and good reproducibility are ensured. The preferred reducing sugar is glucose.

15 Claims, No Drawings

PAD-DYEING OF CELLULOSE FIBERS WITH SULFUR BLACK DYES: MIXTURE OF DITHIONITE AND GLUCOSE REDUCING SUGAR AS REDUCING AGENT IN AQUEOUS ALKALINE DYE BATH

The present invention relates to the field of textile dyeing with sulfur dyes.

Sulfur dyes as such can be obtained by heating suitable organic compounds with elemental sulfur or polysulfides. After vatting with sodium sulfide, the alkali-soluble reduced forms of the sulfur dyes are applied to the fiber, where the original dye is re-formed by subsequent oxidation. The majority of commercially significant sulfur dyes are blacks. Of the sulfur blacks, those under the Colour Index generic name C.I. Sulfur Black 1 are the most important.

One problem of conventional dyeing with sulfur black using sodium sulfide or sodium hydrogensulfide is ecologic. Sulfide and hydrogen sulfide in the waste water and in the waste air are no longer acceptable for the future use of sulfur black. Problems arise due to odor nuisance, acute toxicity and high chemical oxygen demand (COD) values in the waste water.

The sulfide can be present in the commercial sulfur dye, and/or it can be added at the point of use of the dye for dyeing.

In recent years there have been many attempts to use alternative reducing agents with sulfur and vat dyes. None of these systems has been able to solve the ecologic problems for all dyes while preserving let alone improving a good color yield. Alternative reducing agents are for example sodium dithionite (hydrosulfite), sodium sulfoxylate, sodium formaldehydesulfoxylate, sodium boronate, hydroxyacetone, glyceraldehyde, thioglycolic acid, formamidinesulfinic acid and glucose.

These reducing agents all have disadvantages when employed with C.I. Sulfur Black 1, in particular in pad-steam dyeing. For example, reduction of the dye is incomplete (consequence: no color yield), or the dye is over-reduced (consequence: dye destruction), or a very precise amount is required of the reducing agent (consequence: minimal variation of the dyeing parameters tilts the dyeing into failure), preventing safe practice.

Of glucose it is known for example that it always gives distinctly lower color yields than sulfide and that the attainable black is not very deep in shade. Of sodium dithionite it is known that only a very precise amount ensures a high and safe color yield and hence a deep black.

Cellulose fibers have also been printed with vat dyes using mixtures and reaction products of glucose and sodium dithionite (Melliand, Textilberichte 1930, page 286). However, there is still no ecologically acceptable process for textile dyeing with sulfur black dyes.

It is therefore an object of the present invention to make the process for pad-dyeing cellulose fibers with sulfur black dyes ecologically advantageous, i.e. avoid the use of sulfides as reducing agents while at the same time obtaining a high color yield, a deep black shade, high safety and good reproducibility.

This object is achieved according to the present invention when the reducing agent used in the alkaline, aqueous dyebath is a dithionite-based mixture with at least one reducing sugar.

As reducing sugar it is possible to use aldotrioses, aldotetroses, aldopentoses and aldohexoses, preferably glucose, which can be present in solid form or as syrup/molasses, and alkali degradation products thereof and mixtures thereof. As dithionite it is possible to use any alkali metal dithionite, advantageously sodium dithionite.

The mixing ratio can vary between 20 parts by weight of reducing sugar/80 parts by weight of sodium dithionite and 80 parts of reducing sugar/20 parts by weight of sodium dithionite. The mixing ratio is preferably between 40 parts by weight of reducing sugar/60 parts by weight of sodium dithionite and 60 parts by weight of reducing sugar/40 parts by weight of sodium dithionite.

The reducing sugar(s) and the dithionite can be added to the aqueous, alkaline dyeing liquor prior to dyeing either separately or as a ready-produced mixture. As alkali the dyeing liquor contains sodium hydroxide, sodium carbonate, potassium hydroxide and/or potassium carbonate, preferably a mixture of sodium hydroxide and sodium carbonate.

In addition to the reducing agent mixture according to the present invention, further suitable reducing agents may be present in the dyeing, for example hydroxyacetone, sodium sulfoxylate or formamidinesulfinic acid.

Textile material which is dyeable by the process according to the present invention is composed of cellulose fibers, for example cotton, regenerated cellulose, linen, bast fibers and textile material comprising a mixture of cellulose fibers with polyester fibers. The process is particularly suitable for dyeing cotton.

The pad-dyeing process of the present invention can be carried out using sulfur black dyes, mixtures of sulfur black dyes with each other, or mixtures of one or more sulfur black dyes with one or more suitable colored sulfur dyes. Preference is given here to sulfur black dyes of the type C.I. Sulfur Black 1 and to mixtures or combinations thereof with each other or with suitable colored sulfur dyes in which C.I. Sulfur Black 1 is the main component. According to the present invention, C.I. Sulfur Black 1 can be used in the form of an aqueous dispersion, in the form of a water-soluble product of the type C.I. Soluble Sulfur Black 1 or in the form of an aqueous solution of C.I. Leuco Sulfur Black 1 and/or Soluble Sulfur Black 1. Particular preference is given to products of the type C.I. Soluble Sulfur Black 1.

The process of the present invention can be carried out as a customary single- or two-bath pad-steam process with or without intermediate drying, as a pad-roll process or as a pad-dry process.

The dyeing with the novel mixtures of reducing sugars and sodium dithionite can be preferably carried out at temperatures between 100° C. and 105° C. in the case of dyeing processes involving a steaming operation or at temperatures between 100° C. and 140° C. in the case of dyeing processes involving a drying operation.

In the case of pad-dyeing by the single-bath pad-steam process, the alkaline dyeing liquor contains the dye as well as the novel mixture of reducing sugar component and dithionite. The dyeing liquor is applied by padding, and the padded material is then steamed and reoxidized in a conventional manner with an oxidizing liquor.

The two-bath pad-steam process is preferred in the pad-dyeing of mercerized cotton with suitable water-soluble sulfide-free sulfur dyes. In this case, first the dye is applied without alkali and reducing agent, then dried, overpadded with alkali and reducing agent, and finally fixed by steaming.

To dye mixtures of cellulose fibers and polyester fibers it is advantageous to employ the thermosol/single-bath pad-steam process. Here the blend fabric is predyed with a customary disperse dye by the thermosol process. Without intermediate clearing it is overpadded with an alkaline dyeing liquor containing the sulfur dye and the reducing agent, then steamed and reoxidized. It has been found that the novel use of glucose and dithionite leads to significantly better destruction of disperse dye deposits on the cloth than sulfide of glucose alone. Thus, if the dyeing is carried out by means of glucose plus dithionite it is possible to dispense entirely with the intermediate reduction clearing following thermosoling.

Dyeing according to the present invention, in particular if C.I. Soluble Sulfur Black 1 is used, leads in a safer, more reproducible manner to black dyeings having a deep neutral black shade. The black which is obtainable with glucose alone as reducing agent is weak and brownish. Similarly, dyeing with sodium sulfide as reducing agent leads to a relatively weak and slightly brownish black. Dyeing safety and reproducibility remain completely unaffected within the indicated ranges of fluctuation in reagent quantities. Padding liquor stability is on a level with that of sulfide-based padding liquors.

The fastness properties obtainable by the process according to the present invention are better than if glucose or sodium sulfide is used alone. This applies in a particular degree to the dyeing of mixtures of polyester fibers and cotton by the thermosol/single-bath pad-steam process.

The novel process of sulfide-free or low-sulfide sulfur dyeing can in principle also be employed in the case of exhaust dyeings. However, that does not form part of the subject-matter of the present invention.

The inventive concept will now be illustrated by way of example. Parts and percentages are by weight.

EXAMPLES 1) 100 g of a cotton fabric were padded at about 20° C. with a dyeing liquor (wet pickup 80%) containing 100 g/l of a commercial pulverulent dye according to C.I. Soluble Sulfur Black 1, 1 g/l of a commercial alkali-resistant wetting agent (secondary alkanesulfonate type), 13 g/l of sodium hydroxide, 20 g/l of anhydrous sodium carbonate, 30 g/l of glucose and 30 g/l of sodium dithionite. The fabric was steamed at 102° to 103° C. in an airless steamer for 1 minute, then rinsed and reoxidized by a 10-minute treatment at 70° C. in a liquor containing 2 g/l of sodium bromate, 3 $cm^3$/l of 60% acetic acid, and 0.1 g/l of sodium metavanadate. Rinsing and drying left a deep black dyeing having a bright bluish black shade.

2) 100 g of a blend fabric composed of 50% polyester fibers and 50% cotton were padded at 50° C. with a dyeing liquor (wet pickup 65%) containing 240 g/l of a commercial liquid dye according to C.I. Soluble Sulfur Black 1, 10 g/l of sodium hydroxide, 10 g/l of anhydrous sodium carbonate, 25 g/l of glucose and 25 g/l of sodium dithionite. This was followed by steaming at 100° C. for 90 seconds, rinsing and reoxidizing by a 5-minute treatment at 70° C. with a solution containing 3 $cm^3$/l of 35% hydrogen peroxide, 3 $cm^3$/l of 60% acetic acid and 1 g/l of crystalline sodium acetate. Subsequent rinsing and drying left a melange dyeing composed of an undyed polyester portion and deep black cotton.

3) 100 g of a cotton fabric (terry) were padded at about 20° C. with a dyeing liquor (wet pickup 100%) containing 70 g/l of the dye mentioned in Example 1 and also 10 g/l of a commercial dye according to C.I. Sulfur Black 6, plus 30 $cm^3$/l of 38° Bé sodium hydroxide, 10 g/l of potassium carbonate, 100 g/l of a 30% aqueous glucose syrup and 30 g/l of sodium dithionite. Steaming at 105° C., rinsing and treating at 40° C. with an oxidizing liquor containing 3 $cm^3$/l of 35% hydrogen peroxide for 15 minutes left a reddish deep black dyeing.

4) The C.I. Sulfur Black 6 dye mentioned in Example 3 was replaced by an identical amount of C.I. Sulfur Black 7 or 11. A similar dyeing was obtained.

5) A cotton fabric was padded with 1 liter of a dyeing liquor (wet pickup 80%) prepared from 200 g of C.I. Leuco Sulfur Black 1, 1 g of a wetting agent, 80 $cm^3$ of 38° Bé sodium hydroxide, 15 g of galactose, 15 g of dextrin and 30 g of sodium dithionite. Steaming, rinsing, reoxidizing and drying gave a deep black dyeing.

6) A blend fabric composed of 70% polyester fibers and 30% cotton was predyed in a conventional manner by the thermosol method with a commercial disperse black based on C.I. Disperse Yellow 114, C.I. Disperse Red 167 and C.I. Disperse Blue 79:1. Without intermediate clearing the fabric was overpadded at about 20° C. with a liquor of the composition of Example 1. This was followed by steaming at 100° C. to 102° C. for 1 minute, rinsing and reoxidizing. The result obtained was a black dyeing which, in a test of the wash fastness at 60° C. with household detergents against a multifiber strip as adjacent material, gave a much better result than a conventional dyeing with C.I. Sulfur Black 1 using sodium sulfide.

7) A viscose staple fabric was padded at 20° to 30° C. with a dyeing liquor (wet pickup 90%) containing 300 g/l of a commercial liquid dye according to C.I. Soluble Sulfur Black 1, 40 $cm^3$/l of 38° Bé sodium hydroxide, 20 g/l of anhydrous sodium carbonate, 20 g/l of glyceraldehyde and 30 g/l of sodium dithionite. Steaming, rinsing, reoxidizing and drying gave a deep black dyeing.

8) 12 g of glucose and 48 g of sodium dithionite were used in a procedure otherwise as indicated in Example 1. Again a deep black dyeing was obtained.

9) 40 g of glucose and 10 g of sodium dithionite were used, the dye used in Example 1 was replaced by 200 g of a 25% aqueous dispersion of C.I. Sulfur Black 1, and otherwise the procedure of Example 1 was followed. Again a deep black was obtained.

10) 100 kg of a woven cloth of mercerized cotton were padded at about 20° C. with a liquor containing 350 g/l of a commercial liquid dye of the type C.I. Soluble Sulfur Black 1, 5 $cm^3$/l of 60% acetic acid, 3 g/l of a wetting agent and 15 g/l of a commercial migration inhibitor based on polyacrylate. The wet pickup was 70%, and the cloth was intermediately dried on a hot flue. It was then overpadded at about 20° C. with a reagent liquor containing 50 g/l of the dye padding liquor used, 60 $cm^3$/l of 32.5% sodium hydroxide, 20 g/l of anhydrous sodium carbonate, 20 g/l of glucose and 40 g/l of sodium dithionite with a wet pickup of 80%. Customary finishing left a brilliant, deep black dyeing.

11) A cotton fabric was padded at 50° to 60° C. with a liquor (wet pickup 80%) containing 200 g/l of a commercial dye according to C.I. Leuco Sulfur Black 1, 25

$cm^3/l$ of 50% sodium hydroxide, 40 g/l of glucose and 20 g/l of sodium dithionite. After padding the fabric was dried for 20 seconds by airing and then over lapped drying cylinders. A deep black was obtained.

What is claimed is:

1. A process for pad-dyeing cellulose fibers with sulfur black dyes, which comprises using in the alkaline, aqueous dyebath a reducing agent comprising a dithionite-based mixture with at least one reducing sugar.

2. The process of claim 1, wherein the reducing sugar used is an aldotriose, aldotetrose, aldopentose or aldohexose, or an alkali degradation product thereof or a mixture thereof.

3. The process of claim 1, wherein the dithionite used is an alkali metal dithionite.

4. The process of claim 1, wherein the cellulose fibers dyed are cotton, regenerated cellulose or linen.

5. The process of claim 1, wherein the cellulose fibers are present in a blend with polyester fibers.

6. The process of claim 1, wherein the pad-dyeing is carried out by a single-bath or two-bath pad-steam process with or without intermediate drying.

7. The process of claim 1, wherein the pad-dyeing is carried out as a pad-dry process.

8. The process of claim 1, wherein the sulfur black dye used is a pure sulfur black dye, a mixture of sulfur black dyes with each other or a mixture of one or more sulfur black dyes with one or more other colored sulfur dyes.

9. The process of claim 8, wherein as C.I. Sulfur Black 1 there is or are used one or more products of the type C.I. Leuco Sulfur Black 1 and/or C.I. Soluble Sulfur Black 1.

10. The process as claimed in claim 2, wherein the aldohexose is glucose.

11. The process as claimed in claim 3, wherein the alkali metal dithionite is sodium dithionite.

12. The process as claimed in claim 4, wherein the cellulose fibers dyed are cotton.

13. The process as claimed in claim 8, wherein the pure sulfur black dye is a C.I. Sulfur Black 1.

14. The process as claimed in claim 9, wherein soluble Sulfur Black 1 is used.

15. The process as claimed in claim 1, wherein the reducing sugar is glucose and the dithionite is sodium dithionite.

* * * * *